United States Patent [19]

Sievers

[11] 4,446,764

[45] May 8, 1984

[54] ADJUSTABLE WRENCH ADJUSTING MECHANISM

[75] Inventor: Henry T. Sievers, Sumter, S.C.

[73] Assignee: Cooper Industries, Inc., Houston, Tex.

[21] Appl. No.: 429,876

[22] Filed: Sep. 30, 1982

[51] Int. Cl.[3] ..... B25B 13/16

[52] U.S. Cl. ..... 81/170; 76/114

[58] Field of Search ..... 76/114; 81/155, 165, 81/157, 158, 170, 171, 175, 176

[56] References Cited

U.S. PATENT DOCUMENTS

| | | | |
|---|---|---|---|
| 1,739,715 | 12/1929 | Eckland | 76/114 X |
| 2,112,840 | 4/1938 | Haist | 76/114 |
| 2,905,037 | 9/1959 | Coslow | 81/165 |
| 3,580,115 | 5/1971 | Thompson | 81/165 |

*Primary Examiner*—James G. Smith

*Attorney, Agent, or Firm*—Eddie E. Scott

[57] ABSTRACT

An adjustable flat wrench having a main body section, a handle and a fixed jaw formed therewith, and a movable jaw which is opened and closed in response to rotation of an adjustment sleeve incorporates a pin having reduced diameter shear sections, so that the pin may easily be sheared out of the wrench, and the adjustment sleeve and movable jaw easily removed for repair or replacement as required. The pin is pressed into the wrench body portion, and that section of the pin which retains the pin in position and which remains following shear and removal of the sheared sections of the pin and adjustment sleeve may be easily removed with a hammer and punch in order that a new pin may be installed in the repaired wrench.

8 Claims, 2 Drawing Figures

ADJUSTABLE WRENCH ADJUSTING MECHANISM

BACKGROUND OF THE INVENTION

1. Field of the Invention

The present invention relates in general to adjustable wrenches, and more specifically to flat adjustable wrenches having a movable jaw that slides to and from an opposing jaw and a rotatable adjustment sleeve mechanism for adjusting the opening between the jaws.

2. Description of the Prior Art

Adjustable flat wrenches of the type having a fixed jaw formed with a handle and a movable jaw adapted to slide toward the fixed jaw are well known. In this type of wrench, the movable jaw is positioned, and retained in position, by an adjustment sleeve having external threads thereon which mesh with teeth or serrations formed on a portion of the sliding jaw. The adjustment sleeve is mounted within a window formed in the body of the wrench to be accessible from both sides of the wrench and operated by a user's thumb. The adjustment sleeve is retained in position by, and rotates about, a pin passing through the axis thereof. The pin is affixed into the body of the wrench, generally at each end thereof, to support the adjustment sleeve.

Occasionally, it is necessary to remove the adjustment sleeve in order to replace it with a new one, or to repair or replace the movable jaw. For this reason, some pins are formed like a shouldered screw, one end being threaded in order to be screwed into the wrench body, and the other end having a slot in the head thereof to receive a screwdriver. Frequently during use, the threaded pin works itself loose and falls out. Therefore, a secondary staking operation is necessary to deform either the pin or the metal surrounding the pin to retain the pin in place. Other devices have a pin which is press-fitted into the wrench body to retain the adjustment sleeve in position. Removal of a press-fit pin is essentially impossible unless a through hole is provided in the wrench body to receive a punch so that the pin may be punched out of the wrench body from the reverse direction. This through hole necessarily weakens the structural integrity of the body of the wrench.

SUMMARY OF THE INVENTION

In accordance with the present invention, an adjustable flat wrench is provided with an adjustment sleeve pin for retaining the adjustment sleeve in position within the wrench body whereby the adjustment sleeve rotates around the pin to adjust the movable jaw. The pin includes two reduced diameter portions defining shear points oriented in alignment with respective end surfaces of the adjustment sleeve so that the pin may be sheared by striking the adjustment sleeve. The remaining portion of the pin in the blind hole will then fall out, and the pressed-in section may be removed with a hammer and punch.

BRIEF DESCRIPTION OF THE DRAWINGS

For a detailed description of the preferred embodiment of the invention, reference is made to the accompanying drawings, in which.

DETAILED DESCRIPTION OF THE INVENTION

Figure 1:
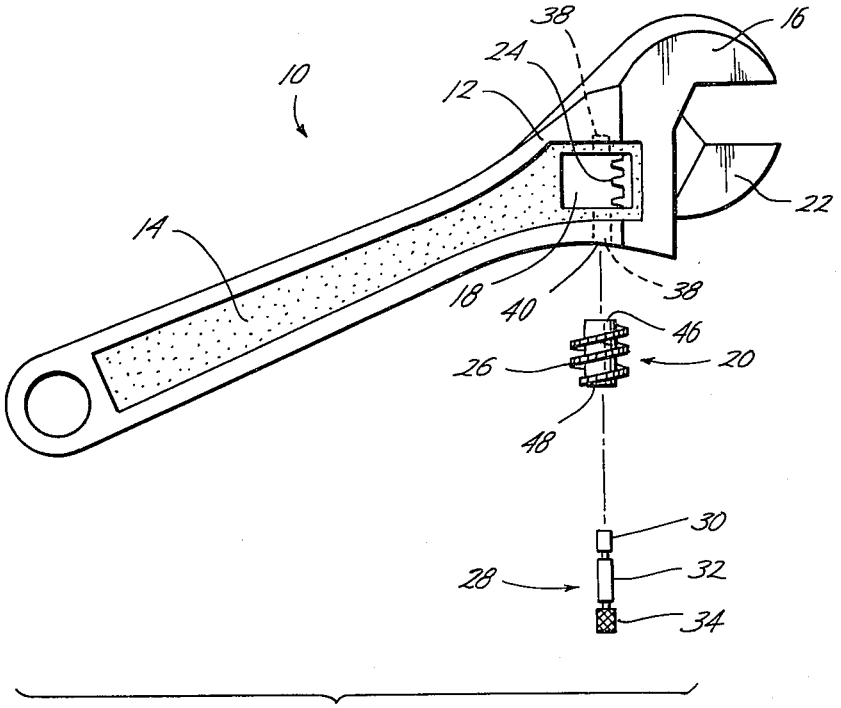
FIG. 1 is a side view of the adjustable wrench of the present invention showing the adjustment sleeve and the modified pin exploded therefrom.

Turning now to the drawings and more specifically to FIG. 1, an adjustable flat wrench is shown, generally illustrated by the numeral 10. The flat wrench 10 comprises a main body section 12, having a handle 14 at one end thereof and a fixed jaw 16 at the other end thereof. The main body section 12 defines a window 18 therein for receiving an adjustment sleeve 20, as will be explained hereinbelow.

A movable jaw 22 is adapted to slide within a track (not shown) in order to close the movable jaw against the fixed jaw 16, in the manner customarily known to those skilled in the art. The movable jaw 22 includes a toothed section 24 which cooperates with the adjustment sleeve 20 to slide the jaw in response to rotation of the adjustment sleeve. In this regard, the adjustment sleeve 20 includes external threads 26 for engaging the jaw teeth 24 to adjust the movable jaw 22 as desired.

Figure 2:
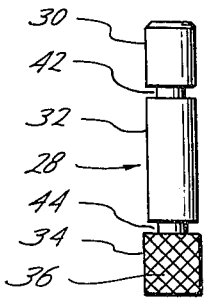
FIG. 2 is an enlarged view of the modified pin of the wrench of the present invention.

The adjustment sleeve 20 is retained in functional position by a retaining pin 28, adapted to be inserted through the adjustment sleeve and press-fitted into the main body section 12 of the adjustable flat wrench of the present invention. This retaining pin 28 is divided into first, central and third sections 30, 32, 34, respectively as is best shown in FIG. 2. In the preferred embodiment, the third section 34 has a larger diameter than the other sections, and includes a roughened exterior surface, as in a knurl 36 or the like.

The retaining pin 28 is received into the wrench main body section 12 into a blind bore 38, passing through the main body section window 18. An initial section 40 of this blind bore 38 may be slightly larger than the blind end in order to accommodate the third knurled section 34 of the retaining pin 28.

The retaining pin 28 includes first and second shear sections 42, 44 dividing the pin into the first, central, and third sections 30, 32, 34. In the preferred embodiment, these pin shear sections 42, 44 take the form of reduced diameter sections that are spaced apart a distance that is essentially equal to the length of the adjustment sleeve 20. In this manner, when the adjustment sleeve 20 is functionally positioned within the main body section window 18 and the retaining pin 28 is positioned therethrough to retain the adjustment sleeve in position, the pin first and second shear sections 42, 44 are in substantial alignment with respective end surfaces 46, 48 of the adjustment sleeve 20. Those skilled in the art will readily appreciate that the diameter of respective shear sections 42, 44 will, of course, be a function of the size of the pin, the size of the adjustment sleeve, the size of the wrench, the strength capability of the wrench, etc., and will be determined to provide sufficient resistance to shear during normal operation of the wrench, yet can be easily sheared when it is desired to remove the adjustment sleeve to repair or replace the adjustment sleeve and/or the movable jaw.

In the preferred embodiment, the pin third section 34 has a diameter that is slightly larger than that of the first or central sections 30, 32. Additionally, the diameter of the first pin section 30 is such that when the pin is functionally inserted into the wrench main body section 12, the pin first section 30 fits into the blind bore 38 tightly enough to preclude the pin from shifting therein as the adjustment sleeve 20 is rotated to adjust the jaw opening, yet loosely enough that the remaining pin first section 30 easily falls out of the blind bore in the event the pin is sheared to effect removal of the adjustment sleeve 20. Of course, the diameter of the pin central section 32 may be essentially the same diameter as that of the first section 30, or alternatively, slightly larger. In any event, the diameter of the pin central section 32 is such that it is functionally received into the axial bore of the adjustment sleeve 20 to permit the adjustment sleeve to freely rotate thereabout. The third pin section 34 is slightly larger than both the first and central pin sections 30, 32, so that it fits tightly into the initial section 40 of the blind bore 38 to retain the pin in functional position within the wrench main body section 12. Preferably, there is sufficient interference between the pin third section 34 and the bore 38 that the pin must be pressed-fitted into the bore in the customary manner, so that the pin will not be worked loose during adjustment of the movable jaw throughout the life of the wrench.

Occasionally, adjustable flat wrenches require repair, rework or replacement of the sliding jaw or the adjustment sleeve. Frequently, this rework is necessary because adjustable flat wrenches sometimes will not operate freely after assembly due to minor out of dimensional tolerance conditions of any one or all parts of the assembly. Such conditions can lead to binding of the adjustment sleeve in the adjustable jaw rack due to a concentricity problem or binding between the adjustable jaw and the fixed jaw due to dimensional interference. In field use, flat adjustable wrenches can be damaged due to improper use or overloading which can damage the adjustment sleeve or the movable jaw and necessitate replacement of either or both parts. In this event, the adjustable flat wrench of the present invention is easily disassembled by following the sequence of steps outlined hereinbelow:

(1) with a hammer or a hammer and a large punch, the user effects a sharp blow to the outside surface of the adjustment sleeve in a direction normal to the axis of rotation thereof; a solid, sharp blow to the adjustment sleeve will cause the pin first and second shear sections 42, 44 to shear, thus freeing the adjustment sleeve 20 from the retaining pin 28;

(2) with the retaining pin 28 thus sheared, the adjustment sleeve 20 can be easily removed by simply pushing with the thumb or light tapping with the punch and hammer;

(3) with the adjustment sleeve 20 removed, the pin first section 30 will readily drop from the blind bore 38; and (4) lastly, the operator uses a hammer and small punch to knock the pin third section 34 through the bore 38 into the body section window 18 and free of the wrench.

After reworking or renewing the movable jaw and/or the adjustment sleeve, a new retaining pin 28 is inserted into the bore 38, through the adjustment sleeve 20 and pressed into the initial section 40 of the bore within the main body section 12 in the customary manner. Thus, the adjustable flat wrench of the present invention has been repaired with minimal time and effort. This rework operation is exceptionally comparatively simple in the instance where, as stated hereinabove, an adjustable flat wrench assembled with a press-fit adjustment sleeve pin fails to operate properly due to a bent pin, non-concentric lineup of the adjustment sleeve, the adjustment sleeve pinhole and the adjustment sleeve pin, or the movable jaw does not slide freely in position with the fixed jaw due to slight dimensional out of tolerance condition of the assembled parts, or a user of the flat adjustable wrench has misused the wrench and resulted in failure of the adjustment sleeve or movable jaw due to overload.

Although particular embodiments of the invention have been illustrated in the accompanying drawings and description in the foregoing Detailed Description of the Invention, it will be understood that the invention is not limited to the embodiments disclosed, but is intended to embrace any alternatives, modifications, rearrangements and/or substitutions of elements as fall within the scope of the invention.

I claim:

1. An adjustable wrench comprising:

(a) a main body section having a handle and a fixed jaw formed therewith;

(b) a movable jaw slidably mounted with said main body section;

(c) a rotatable adjustment sleeve having external threads thereon adapted to cooperate with teeth on said movable jaw to cause said movable jaw to open and close relative to said fixed jaw; and (d) pin means for rotably mounting said adjustment sleeve with said main body section, said pin means including shear means for permitting ready shearing of said pin means in order to easily remove said adjustment sleeve from said wrench main body section.

2. The adjustable wrench as set forth in claim 1, wherein said shear means are spaced apart on said pin means a distance essentially equal to the length of said adjustment sleeve.

3. The adjustable wrench as set forth in claim 2, wherein said shear means are in substantial alignment with respective end surfaces of said adjustment sleeve to facilitate ready shearing of said pin means.

4. The adjustable wrench as set forth in claim 3, wherein said pin means comprises an elongate round pin having first, central and third sections separated by said shear means.

5. The adjustable wrench as set forth in claim 4, wherein said shear means comprises a plurality of reduced diameter portions having smaller cross-sectional areas relative to said first, central and third pin sections, each of said reduced diameter portions defining a section of reduced shear resistance.

6. The adjustable wrench as set forth in claim 5, wherein said third section of said pin has a larger diameter than either of said first or central pin sections.

7. The adjustable wrench as set forth in claim 6, wherein said third section of said pin has a roughened exterior surface thereon for retaining said pin in functional position within said wrench main body section.

8. The adjustable wrench as set forth in claim 7, wherein said pin third section roughened exterior surface is knurled.

* * * * *